United States Patent [19]

Fitzpatrick

[11] Patent Number: 5,028,835

[45] Date of Patent: Jul. 2, 1991

[54] THERMIONIC ENERGY PRODUCTION

[76] Inventor: Gary O. Fitzpatrick, 16966 Cloudcraft Dr., Poway, Calif. 92064

[21] Appl. No.: 419,903

[22] Filed: Oct. 11, 1989

[51] Int. Cl.[5] ..... H01J 45/00

[52] U.S. Cl. ..... 313/14; 313/33; 313/45; 313/310; 313/606; 313/627; 310/306; 136/206

[58] Field of Search ..... 313/14, 33, 37, 45, 313/310, 606, 627; 136/206; 310/306

[56] References Cited

U.S. PATENT DOCUMENTS

| | | | |
|---|---|---|---|
| 2,984,696 | 5/1961 | Shaffer | 136/206 |
| 3,376,437 | 4/1968 | Meyerand, Jr. et al. | 310/306 |
| 3,515,908 | 6/1970 | Caldwell | 310/306 |

*Primary Examiner*—Donald J. Yusko
*Assistant Examiner*—Michael Horabik
*Attorney, Agent, or Firm*—Fliesler, Dubb, Meyer & Lovejoy

[57] ABSTRACT

A thermionic energy converter comprises an emitter, a transparent collector support generally parallel to an emitting surface of the emitter, a conductive film collector from about 10 to about 3,000 Angstroms in thickness covering a support surface of the collector support, and an enclosure for maintaining a controlled atmosphere in the gap between the conductive film collector and the emitting surface. According to another embodiment an improvement is set forth in a thermionic energy converter comprising an emitter, a collector and an enclosure adapted to maintain a controlled atmosphere in the emitter-collector gap. The improvement comprises an insulator post supportingly attaching the emitter and the collector. The embodiments are advantageously used together.

11 Claims, 4 Drawing Sheets

FIGURE 3
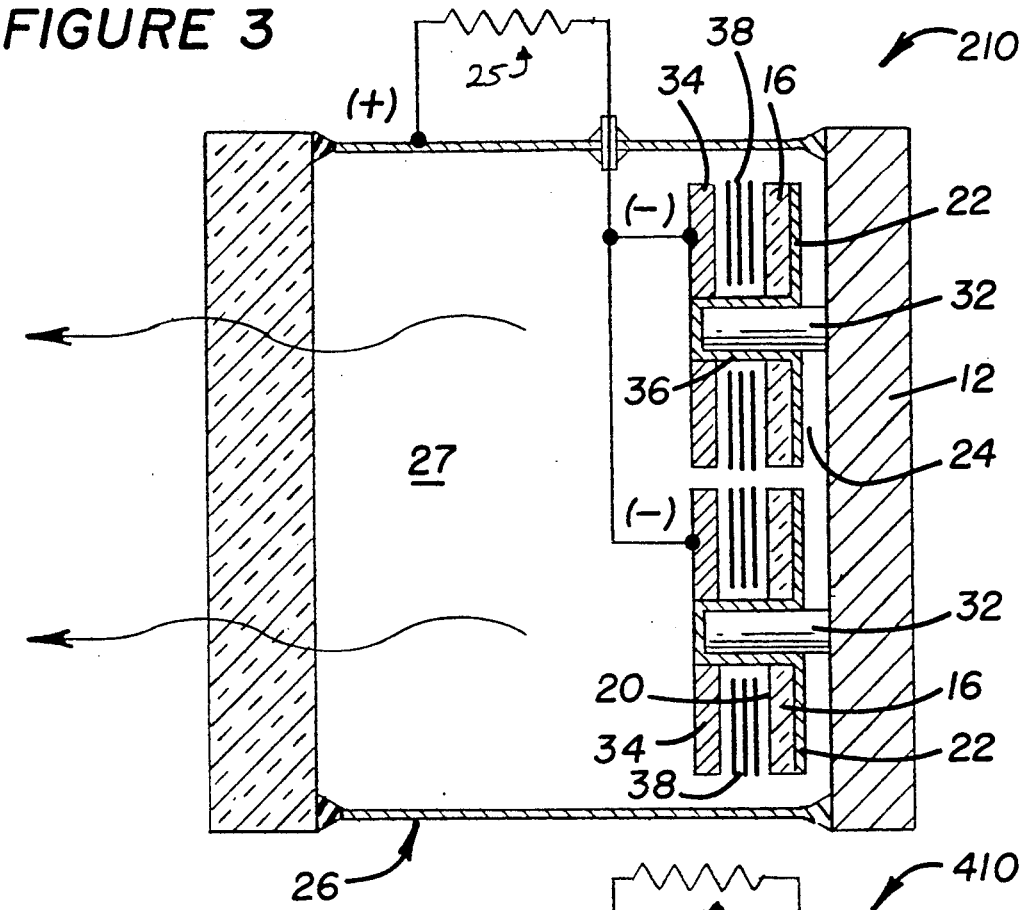
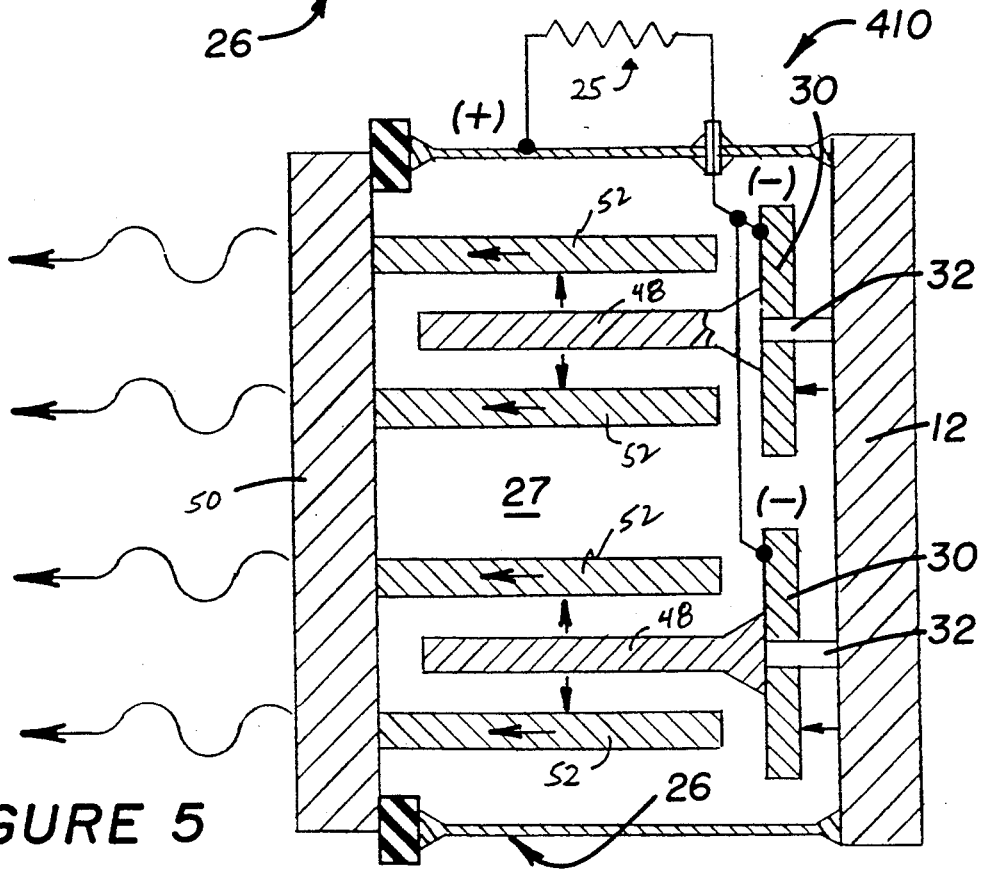
FIGURE 5

THERMIONIC ENERGY PRODUCTION

DESCRIPTION

1. Technical Field

The present invention relates to the thermionic production of energy and, more particularly, to an improved thermionic energy converter.

2. Background Of The Invention

It is well known that electrical energy can be thermionically generated from heat energy. Conventional thermionic converters utilize an emitter which is heated by a heat source to a relatively high temperature whereupon it emits electrons and an adjacent collector which is at a lower temperature. The emitted electrons are received by the collector. The circuit is completed by an external load. Often such converters will have cesium vapor present to aid in their operation. However, they can also operate in a vacuum. Such converters can operate in an ignited mode, a non-ignited mode, a vacuum mode or a quasi vacuum mode.

The ability to control emissivity of a thermionic converter can be important depending upon the use environment of the particular thermionic converter. For example, relatively high emissivity thermionic converters (emissivity of 0.2 to 0.3) are desirable if the thermionic converter is to be used to convert solar radiation or if the converter is to be used externally of the core of a nuclear reactor to convert heat to electricity, while relatively low emissivity thermionic converters are desirable to convert heat within the cores of nuclear reactors. Indeed it would be desirable to have extremely low emissivity, approaching zero, for such applications but current thermionic converters will provide emissivities of no lower than about 0.15. The thermionic converters of the prior art do not generally provide either the capability of controlling their emissivity in this desirable manner or of providing extremely low emissivity, below about 0.15.

Another problem with thermionic converters of the prior art is in maintaining correct and rigid positioning of the collector relative to the emitter. Such is needed to protect against vibrations and shocks both during positioning for, and during, use. For space applications, for example, thermionic converters must be able to stand the shocks of launch. Otherwise, shorting across the emitter-collector gaps may occur.

DISCLOSURE OF INVENTION

The present invention is directed to overcoming one or more of the problems as set forth above.

In accordance with an embodiment of the present invention a thermionic energy converter is set forth. The converter comprises an emitter adapted to be heated to a desired emitting temperature and having an emitting surface. A collector support which is transparent in the visible and infrared has a support surface adjacent, facing and generally parallel to the emitting surface of the emitter and also has a back surface which faces generally away from the emitter. A conductive film collector from about 10 to about 3,000 Angstroms in thickness covers the support surface. The distance between the conductive film collector and the emitting surface defines an emitter-collector gap. An enclosure is also present which is adapted to maintain a controlled atmosphere in the gap.

In accordance with another embodiment of the present invention an improvement is set forth in a thermionic energy converter comprising an emitter, a collector generally parallel to and adjacent the emitter and defining with the emitter an emitter-collector gap and an enclosure adapted to maintain a controlled atmosphere in the gap. The improvement comprises an insulator post supportingly attaching the emitter and the collector.

When one uses a thin conductive film collector supported on a transparent support in accordance with an embodiment of the present invention, heat energy passes through the collector rather than being absorbed by the collector whereby the emissivity of the thermionic converter can be controlled by the designer and, if desired, can be very close to zero. Posts of the nature set forth in accordance with an embodiment of the present invention can provide a very rigid, positive and specific relative placement of the emitter and collector and significant resistance to shocks and vibration. Thus, the aforementioned problems of the prior art are significantly eliminated.

BRIEF DESCRIPTION OF THE DRAWINGS

The invention will be better understood by reference to the figures of the drawings wherein like numbers denote like parts throughout and wherein:

FIG. 3 illustrates, in partial view in section, an embodiment of the present invention combining the embodiments of FIGS. 1 and 2;

FIG. 5 illustrates, in partial view in section, still another embodiment in accordance with the present invention;

BEST MODE FOR CARRYING OUT INVENTION

Figure 1:
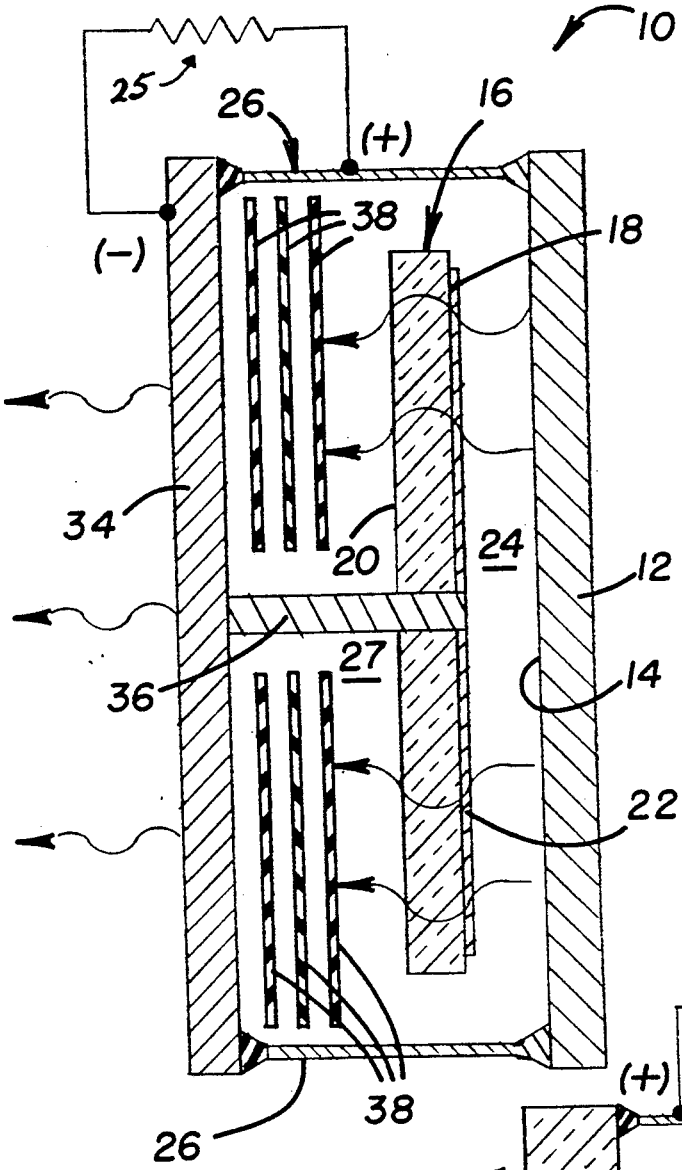
FIG. 1 illustrates, in partial view in section, an emitter in accordance with an embodiment of the present invention.

Adverting first to FIG. 1 there is illustrated a thermionic energy converter 10 in accordance with an embodiment of the invention. The thermionic energy converter 10 comprises an emitter 12 which is adapted to receive and be heated to a desired emitting temperature by radiation or conduction and which has an emitting surface 14. A collector support 16, which is transparent in the visible and infrared, has a support surface 18 adjacent and generally parallel to the emitting surface 14 of the emitter 12. The collector support 16 also has a back surface 20 which faces generally away from the emitter 12. An electrically conductive film collector 22, which is from about 10 to about 3,000 Angstroms in thickness, covers the support surface 18. The distance between the conductive film collector 22 and the emitting surface 14 defines an emitter-collector gap 24. An enclosure 26 is adapted to maintain a controlled atmosphere in the gap 24. A load 25 completes the circuit. In the particular embodiment illustrated the emitter 12 forms a portion of the wall of the enclosure 26. A buss 34, connected by an electrical conductor 36 to the conductive film collector 22, serves as a portion of the enclosure 26. The gap 24, in the embodiment of FIG. 1 the entire interior 27 of the enclosure 26, can be kept at a vacuum or, more usually, will be kept at a vacuum except for the presence of Cs vapor.

Figure 2:
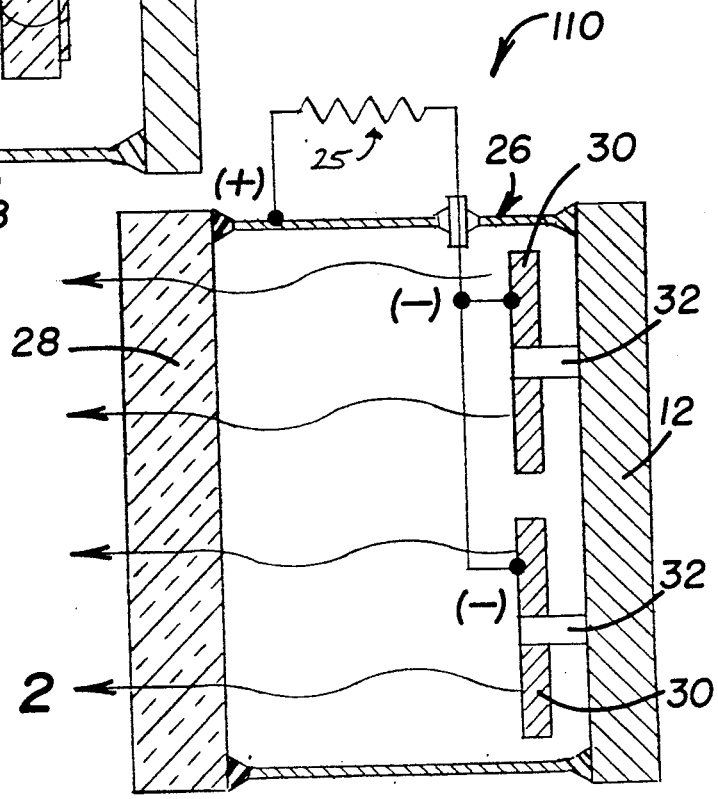
FIG. 2 illustrates, in partial view in section, another embodiment in accordance with the present invention.

Adverting now to FIG. 2 there is illustrated therein an embodiment of a thermionic converter 110 of the present invention which includes the emitter 12, the enclosure 26 and a transparent wall portion 28 through which excess heat can be radiated. In the embodiment of FIG. 2 two electrically conductive collectors 30 are shown, each of which is supported by a post 32 by the emitter 12. This allows precise positioning of the collectors 30 relative to the emitter 12. The posts 32 are made of an insulative material such as alumina. Other usable insulative materials include beryllium oxide, magnesium oxide, ceramics generally, glasses, low conductivity metals such as stainless steel, iron, inconel, monel, or the like and generally any rigid insulative material capable of standing the temperature of operation of the particular emitter 12, which temperature can be in the range from 800° K. up to the melting or decomposition temperature of the particular emitter 12. As a practical matter the maximum emitter temperature will suitably be below about 3000° K. The posts 32 can be connected to the emitter 12 and to the collector 30 (in the case of FIG. 3 to the buss 34 which supports the conductors 36, which support the collector support 16, which thereby supports the conductive film collector 22). Such connection can be by brazing, force fit in appropriate receptors, or the like.

FIG. 3 illustrates an embodiment of the present invention which combines several of the features of the FIG. 1 and FIG. 2 embodiments. The thermionic converter 210 of FIG. 3 includes the posts 32 as shown in FIG. 2 for relatively positioning the emitter 12 and the conductive film collector 22. In the embodiment of FIG. 3, as in the embodiment of FIG. 1, the conductive film collector 22 is supported by the transparent collector support 16. Both the embodiments of FIGS. 1 and 3 utilize the collector buss 34 positioned a spaced distance away from the back surface 20 of and extending generally parallel to the collector support 16. The electrical conductor 36, in addition to providing support, serves for electrically communicating the conductive film collector 22 with the collector buss 34.

In accordance with the embodiments of FIGS. 1 and 3 there is at least one opaque insulator 38 which is generally parallel to, positioned between and generally co-extensive with the back surface 20 of the collector support 16 and with the collector buss 34. As is seen in FIGS. 1 and 3 more than one of the insulators 38 can be utilized and, indeed, it is preferred to utilize a plurality of such insulators 38. Energy which passes from the emitter 12 through the conductive film collector 22 and through the transparent collector support 16 impinges on the first of the opaque insulators 38. That opaque insulator 38 then radiates energy both outwardly towards the collector buss 34 and back towards the emitter 12. The same thing happens with each successive one of the opaque insulators 38. As a result, a significant temperature differential is realized and maintained between the emitter 12 and the collector buss 34. For example, if the temperature of the emitter 12 is 1,800° K., the temperature of the collector buss can be controlled to be no more than about 1,000° K. The intermediate opaque insulators 38 then have intermediate temperatures. The opaque insulators 38 are held in position by being entrapped by the surrounding structures. Protrusions 39, seen in FIG. 6, serve to keep adjacent of the insulators 38 from conductively reaching the same temperatures.

The energy which heats the emitter 12 can come from any of a number of sources. For example, the energy which heats the emitter 12 can come from burning fossil fuel, from a nuclear reactor, or from the sun. The collector support 16 must be transparent in the visible and in the infrared. A number of different materials can be utilized. Generally, sapphire is preferred because of its transparency, strength and relative ease of construction. Other materials which can also be used as the collector support 16 include diamond and glass or any other transparent material having an appropriately high melting point.

When the insulators 38 are used along with the transparent collector support 16 and the thin conductive film collector 22 the emissivity of the thermionic converter 10, 210 or 310 is significantly lowered. At an emitter temperature of 2,000° K. and with an emitter emissivity of about 0.3, the collector temperature can be kept to about 1,000° K. with an emissivity of about 0.02 (due to transparency) the overall thermionic converter 10, 210 or 310 will have an emissivity of only about 0.02. Such follows from the equation for heat input, $Q_{in}$, which is: $Q_{in}(w/cm^2)=1.8\times10^{-3}JT_E+1.2\times10^{-12}(T_E^4-T_C^4)$, wherein $T_E$ and $T_C$ are in °K. and J is amp/cm$^2$. If less insulators 38 are used, or if a thicker conductive film 22 is used, a selectively higher thermionic converter emissivity will result. Thus, through using properly selected geometries, materials and components the emissivity of a thermionic converter can be selected by the designer.

Figure 7:
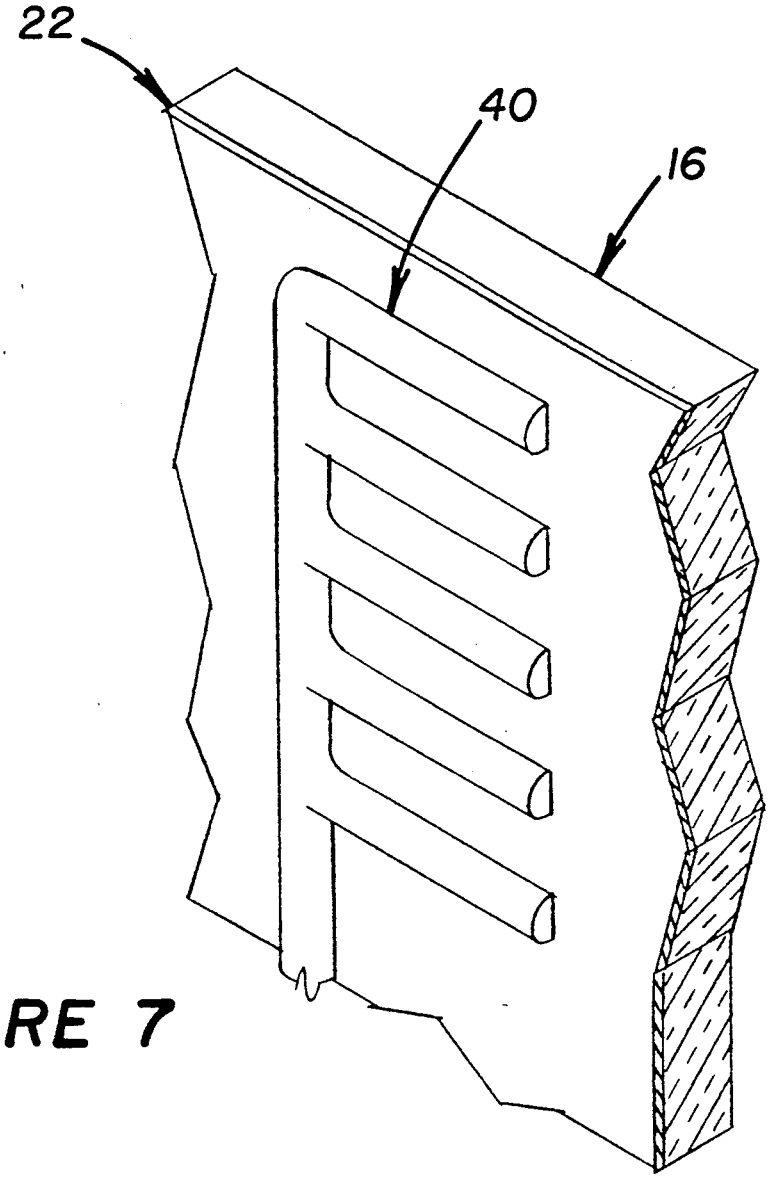
FIG. 7 illustrates, in partial isometric view, an alternate detail useful with embodiments in accordance with the present invention.

The conductive film collector 22 should generally be from about 10 to about 3000 Angstroms in thickness. It is generally preferred that it be from about 10 to about 1000 Angstroms in thickness. For best transparency, e.g., 80% or more, the thickness should be no more than about 200 Angstroms. Thus, the most preferred thickness range is 10 to 200 Angstroms. It is necessary that the conductive film collector 22 be relatively thin so that it will be transparent whereby it will not absorb too much heat. If it is too thin it will generally not be an especially good conductor for conducting electricity to the collector buss 34. This can be corrected for, if desired, by providing an electrically conductive pattern of metal lines 40, as shown in FIG. 7, upon the conductive film collector 22, and having the lines 40 connect to the conductor 36. A minimal number of relatively narrow lines 40 are suitably used to minimize absorption by such lines 40 while still providing the necessary conductivity.

The conductive film collector 22 can be made of any suitable metal or alloy which has sufficient conductivity and can be readily laid down. Useful metals include, for example, copper, gold, aluminum, molybdenum, niobium, tungsten, platinum, nickel, iron, chromium, rhenium, manganese, palladium, lead, tin, zinc, titanium and silver. Copper is generally preferred because of its relatively low cost and high conductivity. Other conductive materials, for example, a metal-ceramic such as molybdenum oxide, niobium oxide or niobium oxygen carbon can be used in place of a metal.

Figure 8:
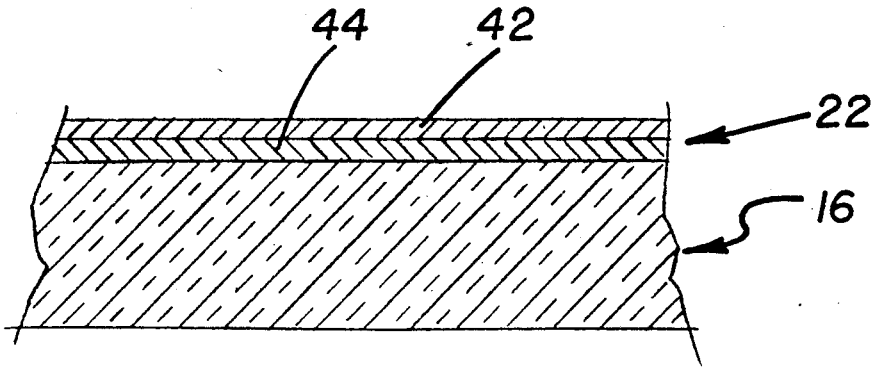
FIG. 8 illustrates, in partial view, a detail useful with embodiments in accordance with the present invention.

As illustrated in FIG. 8 it may be necessary in order to get a continuous copper film on a sapphire collector support 16 to first deposit an intermediate layer of another metal which better wets the sapphire. A very thin layer of nickel, for example, can be utilized between the sapphire collector support 16 and the copper whereby the overall film 22 will be of a sandwich structure and will include the two layers 42 and 44 with the layer 42 being copper and the layer 44 being nickel. Silver or gold can be utilized as film materials but are generally not desirable because of their reactivity with the cesium vapor which fills the gap 24 in all save the vacuum mode of operation. The opaque thermal insulators 38 can be made of any of a number of materials. For example they can be ceramic, glass, low conductivity metals such as stainless steel, iron, inconel, monel or the like, high temperature stable polymers or composites, or the like. They must, of course, be stable at their use temperature.

The emitter-collector gap 24 can be selected to provide a desired mode of operation, ignited or non-ignited, vacuum or quasi vacuum as the case may be. The amount of cesium can likewise be adjusted for mode selection. Ignited mode converters generally operate with a cesium atom density of about $10^{-16}$ (about 1 Torr) and a plasma density of about $10^{-13}$ to $10^{-14}$ per cubic centimeter in the interelectrode space. An arc drop (voltage loss) of about 0.5 eV is required to maintain this plasma. It is possible to produce the ions for space charge neutralization in a thermionic converter more efficiently by emission from the hot emitter surface. However, the ion density produced in this way is relatively small except with high emitter temperatures (above about 2,000° K). This type of unignited mode operation is particularly attractive at close electrode spacing which minimizes electron scattering. If the pressure between the electrodes is maintained low enough so that the electron mean free path is greater than the interelectrode gap, electron transport occurs essentially without scattering. This type of discharge is known as Knudsen discharge.

It is known that operation in the Knudsen mode can lead to high performance. Power densities of 60 watts per square centimeter with a spacing of 0.1 mm (100 microns) and an emitter temperature of 2,770° K. have been reported. The conversion efficiency corresponding to that operating point is about 40%.

In the lowest pressure extreme of the Knudsen discharge operation, the vacuum space charge mode is reached. There are no interelectrode losses with the vacuum mode discharge; however, in order to obtain reasonable current densities, very close spacing (less than about 10 microns) between the electrodes is necessary.

Figure 4:
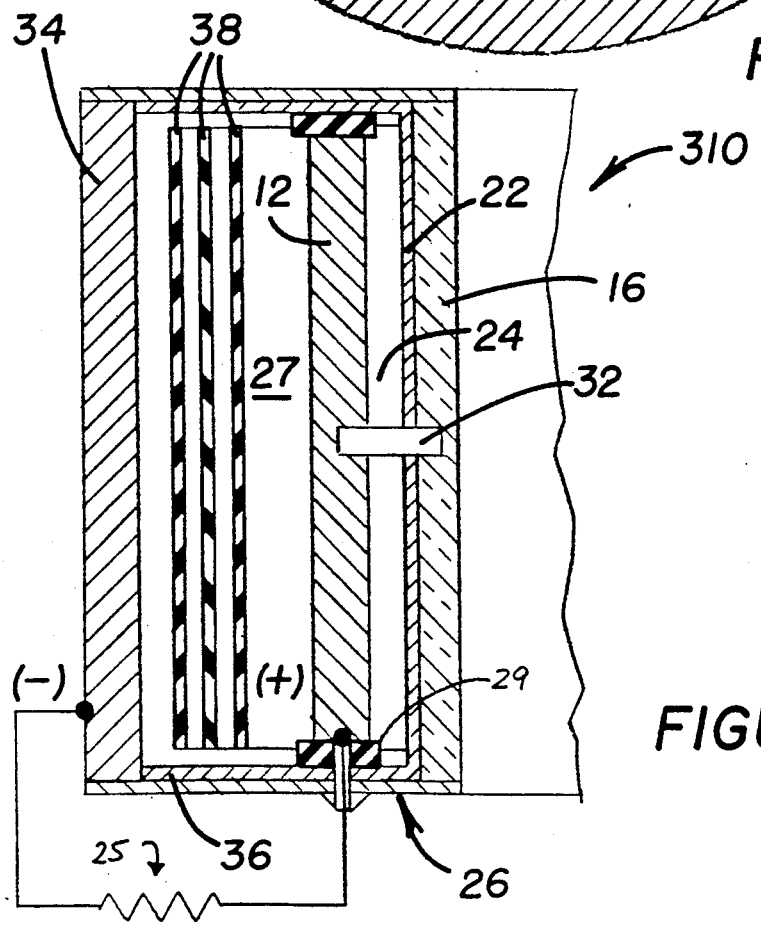
FIG. 4 illustrates, in partial view in section, yet another embodiment in accordance with the present invention.

FIG. 4 illustrates an embodiment of the present invention wherein the collector support 16 forms a portion of the enclosure 26 and the collector buss 34 forms another portion of the enclosure 26. In the embodiment of FIG. 4 radiant energy, for example, concentrated sunlight, passes through the collector support 16 and through the thin metal film 22 and thereafter impinges upon the emitter 12. Positioning of the emitter 12 and of the collector support 16 is provided by a post 32 which, in the embodiment of FIG. 4, fits in appropriately positioned wells in the collector support 16 and in the emitter 12. As the emitter 12 is heated by the radiation which reaches it, the emitter 12 emits electrons which impinge upon the metal film 22 thus creating a relatively negative charge on the metal film 22 and a relatively positive charge on the emitter 12. The conductor 36 provides electrical conducting communication between the metal film 24 and the collector buss 34. An appropriate insulator 29 prevents electrical contact between the emitter 12 and the electrical conductor 36. A plurality of insulators 38 are positioned between the emitter 12 and the collector buss 34. Thus, the collector buss 34 is kept at a significantly lower temperature than the emitter 12. For example, if the emitter 12 is at a temperature of about 1,800° K. then the collector buss 34 can be at a temperature of 1,000° K. Accordingly, a relatively lower emissivity thermionic converter 310 is formed.

Figure 6:
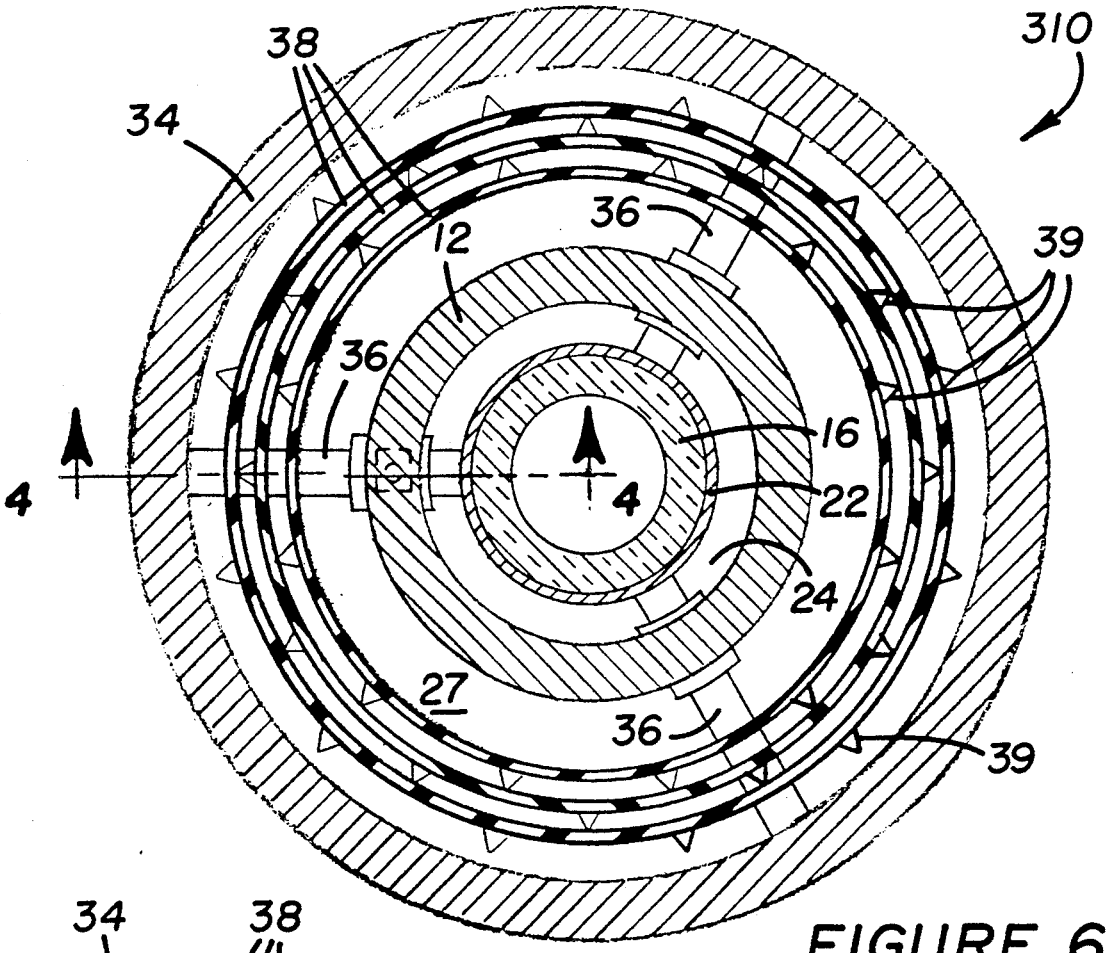
FIG. 6 illustrates, in top partially cut away view, one possible geometric arrangement of an embodiment in accordance with the present invention.

Adverting to FIG. 6 one specific geometry which can be utilized with the FIG. 4 embodiment is illustrated. It should be noted that such geometry can be utilized, likewise, with other embodiments of the present invention. In the embodiment of FIG. 6 the transparent collector support 16 is cylindrical in shape as is the emitter 12, the insulators 38 and the collector buss 34. Three electrical conductors 36 are illustrated in FIG. 6 although more or less can be utilized. Indeed, a circular electrically conducting sheet can be used as the electrical conductor 36. It should also be noted that it is not necessary to utilize the geometry shown in FIG. 6 when the FIG. 4 embodiment is utilized. Instead, a linear arrangement can be utilized.

It should also be noted that in several embodiments of the present invention there is more than one collector 16 or 30 utilized within a single enclosure 26. Thus, the use of a plurality of thin metal collectors 22 or collectors 30 within a single enclosure 26 is contemplated as falling within the scope of the invention.

FIG. 5 illustrated an embodiment somewhat like that of FIG. 2 but varying in that the collectors 30 each have respective heat conductive cooling fins 48 and in that the enclosure 26 includes a metal wall 50 on the opposite side of the collectors 30 from the emitter 12 and that the metal wall 50 includes a plurality of heat conductive extensions 52 which extend adjacent and generally along the fins 48 which are attached to the collector 30. In this manner the fins 48 can very efficiently radiate energy to the extensions 52 which can then conduct heat to the metal wall portion 50 wherefrom it can radiate away from the thermionic converter 410.

Industrial Applicability

The present invention provides thermionic energy converters 10, 110, etc. useful for generating electrical energy from thermal energy.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A thermionic energy converter comprising:

an emitter adapted to be heated to an emitting temperature and having an emitting surface and an opposite emitting surface;

a collector support which is transparent in the visible and infrared and has a support surface adjacent and generally parallel to said emitting surface and a back surface facing generally away from said emitter;

a conductive film collector from about 10 to about 3,000 Angstroms in thickness covering said support surface, the distance between said conductive film collector and said emitting surface defining an emitter-collector gap;

an enclosure adapted to maintain a controlled atmosphere in said gap;

a collector buss positioned a spaced distance away from said back surface of and extending generally parallel to said support;

an electrical conductor electrically communicating said conductive film collector with said collector buss; and at least one opaque thermal insulator generally parallel to, positioned between and generally co-extensive with said back surface of said support and said collector buss.

2. A thermionic energy converter as set forth in claim 1, wherein there are a plurality of said insulators.

3. A thermionic energy converter as set forth in claim 1, wherein said enclosure indicates a transparent wall portion opposite said collector buss.

4. A thermionic energy converter as set forth in claim 3, further including:

an insulator post extending from said emitter and supporting said collector support.

5. A thermionic energy converter as set forth in claim 4, including corresponding pluralities of said collector supports, said metal film collectors, said collector busses, said electrical conductors and said opaque thermal insulators within said enclosure.

6. A thermionic energy converter as set forth in claim 3, including corresponding pluralities of said collector supports, said metal film collectors, said collector busses, said electrical conductors and said opaque thermal insulators within said enclosure.

7. A thermionic energy converter comprising:

an emitter adapted to be heated to an emitting temperature and having an emitting surface and an opposite emitting surface;

a collector support which is transparent in the visible and infrared and has a support surface adjacent and generally parallel to said emitting surface and a back surface facing generally away from said emitter;

a conductive film collector from about 10 to about 3,000 Angstroms in thickness covering said support surface, the distance between said conductive film collector and said emitting surface defining an emitter-collector gap;

an enclosure adapted to maintain a controlled atmosphere in said gap;

a collector buss positioned a spaced distance away from said opposite emitting surface of and extending generally parallel to said emitter;

an electrical conductor electrically communicating said conductive film collector with said collector buss; and at least one opaque thermal insulator generally parallel to, positioned between and generally co-extensive with said opposite emitting surface of said emitter and said collector buss.

8. A thermionic energy converter as set forth in claim 7, wherein there are a plurality of said insulators.

9. A thermionic energy converter as set forth in claim 8, further including:

an insulator post extending from said collector support and supporting said emitter.

10. A thermionic energy converter as set forth in claim 7, further including:

an insulator post extending from said collector support supporting said emitter.

11. In a thermionic energy converter comprising an emitter, a metallic collector generally parallel to and adjacent said emitter to define an emitter-collector gap and an enclosure adapted to maintain a controlled atmosphere in said gap, an improvement which comprises:

an insulator post supportingly attaching said emitter and said collector;

a fin extending from said collector a selected distance away from said emitter;

wherein said enclosure includes a metallic wall portion on an opposite side of said collector from said emitter, said metal wall portion being spaced from said collector more than said selected distance; and a heat conductive extension extending from said metal wall portion towards and ending short of said collector, said extension extending adjacent and generally along said fin.

* * * * *